US009624780B2

(12) United States Patent
Deallenbach et al.

(10) Patent No.: US 9,624,780 B2
(45) Date of Patent: Apr. 18, 2017

(54) SYSTEM AND METHOD FOR SECURING AXIALLY INSERTED BUCKETS TO A ROTOR ASSEMBLY

(71) Applicant: General Electric Company, Schenectady, NY (US)

(72) Inventors: Robert Edward Deallenbach, Flat Rock, NC (US); Ravichandran Pazhur Nair, Glenville, NY (US); Douglas Arthur Lupe, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 583 days.

(21) Appl. No.: 14/109,526

(22) Filed: Dec. 17, 2013

(65) Prior Publication Data

US 2015/0167471 A1 Jun. 18, 2015

(51) Int. Cl.
*F01D 5/12* (2006.01)
*F01D 5/22* (2006.01)
*F01D 5/32* (2006.01)

(52) U.S. Cl.
CPC ..... *F01D 5/22* (2013.01); *F01D 5/32* (2013.01); *F01D 5/326* (2013.01); *F05D 2230/60* (2013.01); *Y10T 29/49318* (2015.01)

(58) Field of Classification Search
CPC ..... F01D 5/16; F01D 5/22; F01D 5/26; F01D 5/3007; F01D 5/32; F01D 5/323; F01D 5/326; F01D 11/006; F01D 11/008; Y10T 29/49318; Y10T 29/4932; Y10T 29/49321; F05D 2230/60
See application file for complete search history.

(56) References Cited

U.S. PATENT DOCUMENTS 4,516,910 A * 5/1985 Bouiller ..... F01D 5/22 416/190
4,767,247 A * 8/1988 Partington ..... F01D 5/22 416/193 A
5,226,784 A * 7/1993 Mueller ..... F01D 5/22 416/248
5,302,085 A * 4/1994 Dietz ..... F01D 5/22 416/193 A
5,478,207 A * 12/1995 Stec ..... F01D 5/22 416/219 R
5,509,784 A 4/1996 Caruso et al.
(Continued)

*Primary Examiner* — Richard Edgar
*Assistant Examiner* — Jesse Prager
(74) *Attorney, Agent, or Firm* — Armstrong Teasdale LLP

(57) ABSTRACT

A rotor wheel assembly includes a rotor wheel having a plurality of dovetail slots spaced circumferentially about a peripheral surface of the rotor wheel. The rotor wheel also has a plurality of notches formed in the peripheral surface. The rotor wheel assembly includes at least one bucket having an integral cover, an airfoil, a dovetail, and a platform having a first surface and an opposite second surface. The first surface of the platform includes a keyway. The keyway has an opposing tapered surface oriented at a first angle relative to the first surface of the platform. Furthermore, the rotor wheel assembly includes a wedge key having first face that is oriented substantially parallel to the first surface of the platform and an opposite second face that is oriented at the first angle relative to the first face, such that the second face is substantially parallel to the taper surface.

20 Claims, 9 Drawing Sheets

(56) References Cited

U.S. PATENT DOCUMENTS

| | | | | |
|---|---|---|---|---|
| 6,030,178 | A | 2/2000 | Caruso | |
| 6,416,286 | B1 | 7/2002 | Roberts et al. | |
| 6,478,544 | B2 * | 11/2002 | Brandl | F01D 5/22 416/190 |
| 7,270,518 | B2 | 9/2007 | Barb et al. | |
| 7,344,359 | B2 | 3/2008 | Deallenbach et al. | |
| 2010/0028135 | A1 * | 2/2010 | Hunt | F01D 5/10 415/119 |
| 2013/0071248 | A1 * | 3/2013 | Hogberg | F01D 5/22 416/221 |

* cited by examiner

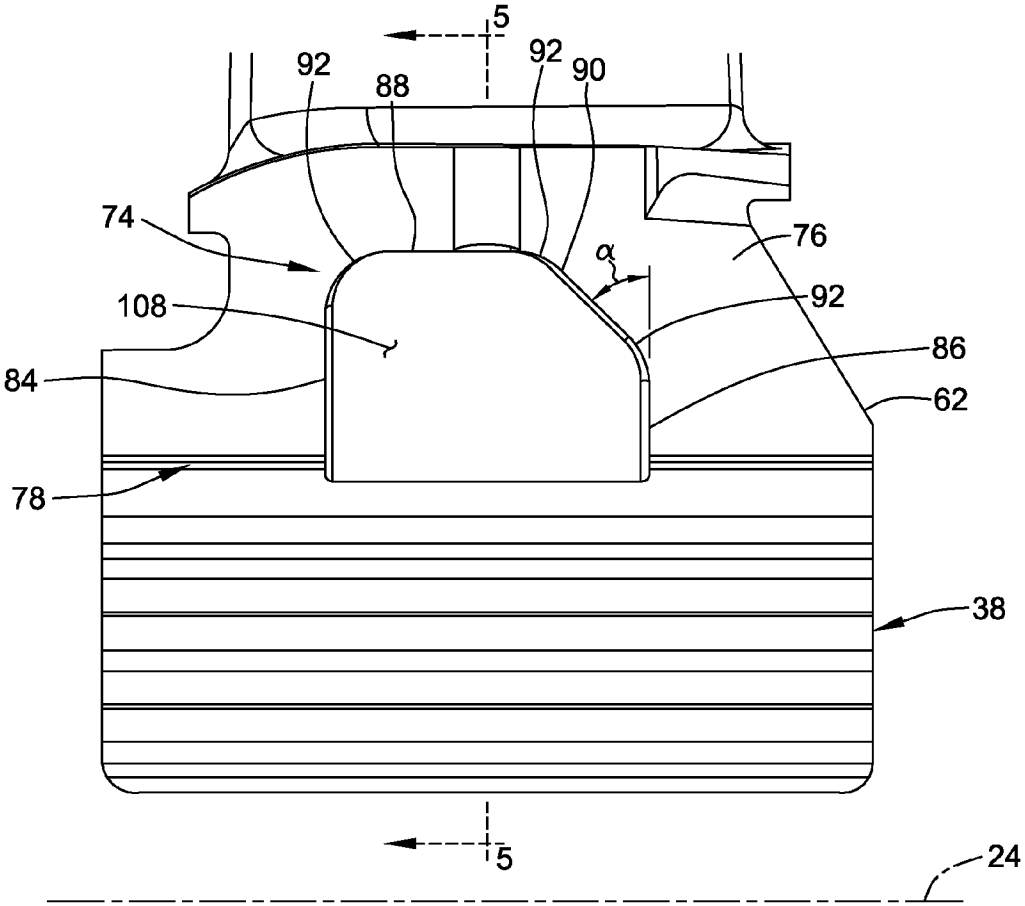
FIG. 4
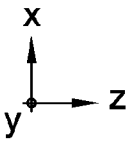

SYSTEM AND METHOD FOR SECURING AXIALLY INSERTED BUCKETS TO A ROTOR ASSEMBLY

BACKGROUND OF THE INVENTION

The present invention relates generally to turbine engines, and more particularly, to systems and methods for use in securing buckets to a turbine engine rotor wheel assembly.

At least some known turbine engines, such as gas turbines and steam turbines, use axial entry buckets, i.e., rotor blades that are coupled to a rotor wheel by sliding the buckets generally parallel to the rotor axis into mating dovetail slots defined on the rotor wheel. Some known buckets include radial-inwardly projecting dovetails that mate in dovetail slots formed on the rotor wheel. The rotor wheel dovetail slots are circumferentially-spaced apart from each other about the periphery of the rotor wheel.

Some known turbine engines may also extend integral covers between circumferentially-adjacent buckets to dampen vibratory responses of the buckets and to increase the buckets' natural frequencies. The buckets each have a natural frequency at which it will resonate when excited. As buckets resonate, stresses in the buckets may rise and fall. Over time these oscillating stresses may cause the buckets to fail due to material fatigue. The magnitudes of the oscillating stresses in the buckets may be reduced and the bucket lives may be increased by increasing the natural frequencies and/or by damping the vibratory response of these parts. It may be desirable, however, that the buckets be tightly coupled at the bucket platforms in the circumferential direction to increase bucket natural frequencies, to reduce dynamic stresses in the dovetail, and to enable accurate standing assembled vibration test data to be gathered for tuning and frequency validation purposes.

In at least some known turbine engines that use integrally covered buckets, the buckets may be secured in the dovetail slots using keys located in grooves in the outer circumference of the rotor wheel and recesses in the sides of the buckets. A closure bucket may be secured to the rotor wheel using a dovetail segment that includes dovetails that extend generally opposite to each other. The rotor wheel may include a conventional dovetail slot that receives the dovetail segment. However, rather than a dovetail, the closure bucket may have a dovetail slot that accepts a dovetail of the dovetail segment. However, as the buckets are coupled about the rotor wheel using the dovetail system, the integral covers of the first and the next to the last assembled buckets may prevent insertion of the closure bucket. As a result, in at least some known turbine engines, keys cannot be used due to the need to move at least some of the buckets axially during insertion of the closure bucket.

In such known turbine engines, twist locks may be used to keep the buckets from shifting axially on the rotor wheel after assembly. The twist locks may be inserted in channels formed in the bottom of the dovetails. Prior to insertion of the closure bucket, the twist locks may be unlocked, to enable buckets adjacent to the closure bucket to be selectively moved apart. After the closure bucket is inserted into the rotor wheel, the twist locks may be relocked to prevent the buckets from moving axially on the rotor wheel. However, using twist locks increases the cost associated with such turbine engines and may also increase operating stresses induced to the rotor wheel assembly. Moreover, such twist locks do not enable tight coupling at the bucket platforms in the circumferential direction to raise bucket natural frequencies, and/or to reduced dynamic stresses in the dovetail.

BRIEF DESCRIPTION OF THE INVENTION

In one aspect, a rotor wheel assembly comprising is provided. The rotor wheel assembly includes a rotor wheel having a plurality of dovetail slots spaced circumferentially about a peripheral surface of the rotor wheel. The rotor wheel also includes a plurality of notches formed in the peripheral surface. In addition, the rotor wheel assembly includes at least one bucket having an integral cover, an airfoil, a dovetail, and a platform. The platform has a first surface and an opposite second surface. The first surface includes a keyway formed therein. The keyway has an opposing tapered surface oriented at a first angle relative to the platform first surface. Furthermore, the rotor wheel assembly includes a wedge key having first face that is oriented substantially parallel to the platform first surface and an opposite second face that is oriented at the first angle relative to the first face, such that the second face is substantially parallel to the tapered surface.

In another aspect, a turbine engine is provided. The turbine engine includes a rotatable shaft having an axis of rotation. The turbine engine also includes a casing extending circumferentially about the rotatable shaft. The casing defines at least one passage configured to channel a working fluid along a length of the rotatable shaft. The turbine engine also includes a rotor wheel assembly attached to a portion of the rotatable shaft for rotation therewith. The rotor wheel assembly is configured to expand the working fluid. The rotor wheel assembly includes a rotor wheel having a plurality of dovetail slots spaced circumferentially about a periphery of the rotor wheel. The rotor wheel also includes a plurality of notches formed in the peripheral surface. Furthermore, the rotor wheel assembly includes a plurality of buckets arranged in a circumferential array about the axis of rotation. Each of the buckets includes a dovetail configured to attach to a respective one of the plurality of dovetail slots, a platform, an airfoil, and an integral cover formed integrally with the bucket. The platform has a first surface and an opposite second surface. The first surface includes a keyway formed therein. The keyway has an opposing tapered surface oriented at a first angle relative to the platform first surface. Furthermore, the rotor wheel assembly includes a wedge key having first face that is oriented substantially parallel to the platform first surface and an opposite second face that is oriented at the first angle relative to the first face, such that the second face is substantially parallel to the tapered surface.

In yet another aspect, a method of assembling a rotor wheel assembly is provided. The rotor wheel assembly has a plurality of buckets and a rotor wheel having a plurality of dovetail slots spaced circumferentially about a periphery of the rotor wheel. Each bucket includes a dovetail, a platform, an airfoil, and an integral cover. The method includes coupling a first bucket to the rotor wheel including inserting the dovetail of the first bucket into a first dovetail slot. The method also includes securing the first bucket to the rotor wheel using a wedge key. In addition, the method includes coupling a second bucket to the rotor wheel comprising inserting the dovetail of the second bucket into a second dovetail slot adjacent the first dovetail slot proximate the wedge key. Furthermore, the method includes rotating the rotor wheel assembly up to an operating speed. The method also includes coupling the first bucket to the second bucket using the wedge key, wherein a frictional contact force is generated between the first bucket and the wedge key, and the second bucket and the wedge key.

BRIEF DESCRIPTION OF THE DRAWINGS

FIG. 4 is a partial side view of an exemplary bucket that may be used with the rotor wheel assembly shown in FIG. 2, and looking substantially perpendicular to the X-Z plane;

DETAILED DESCRIPTION OF THE INVENTION

As used herein, the terms "axial" and "axially" refer to directions and orientations extending substantially parallel to a longitudinal axis of a turbine engine. Moreover, the terms "radial" and "radially" refer to directions and orientations extending substantially perpendicular to the longitudinal axis of the turbine engine. In addition, as used herein, the terms "circumferential" and "circumferentially" refer to directions and orientations extending arcuately about the longitudinal axis of the turbine engine.

Figure 1:
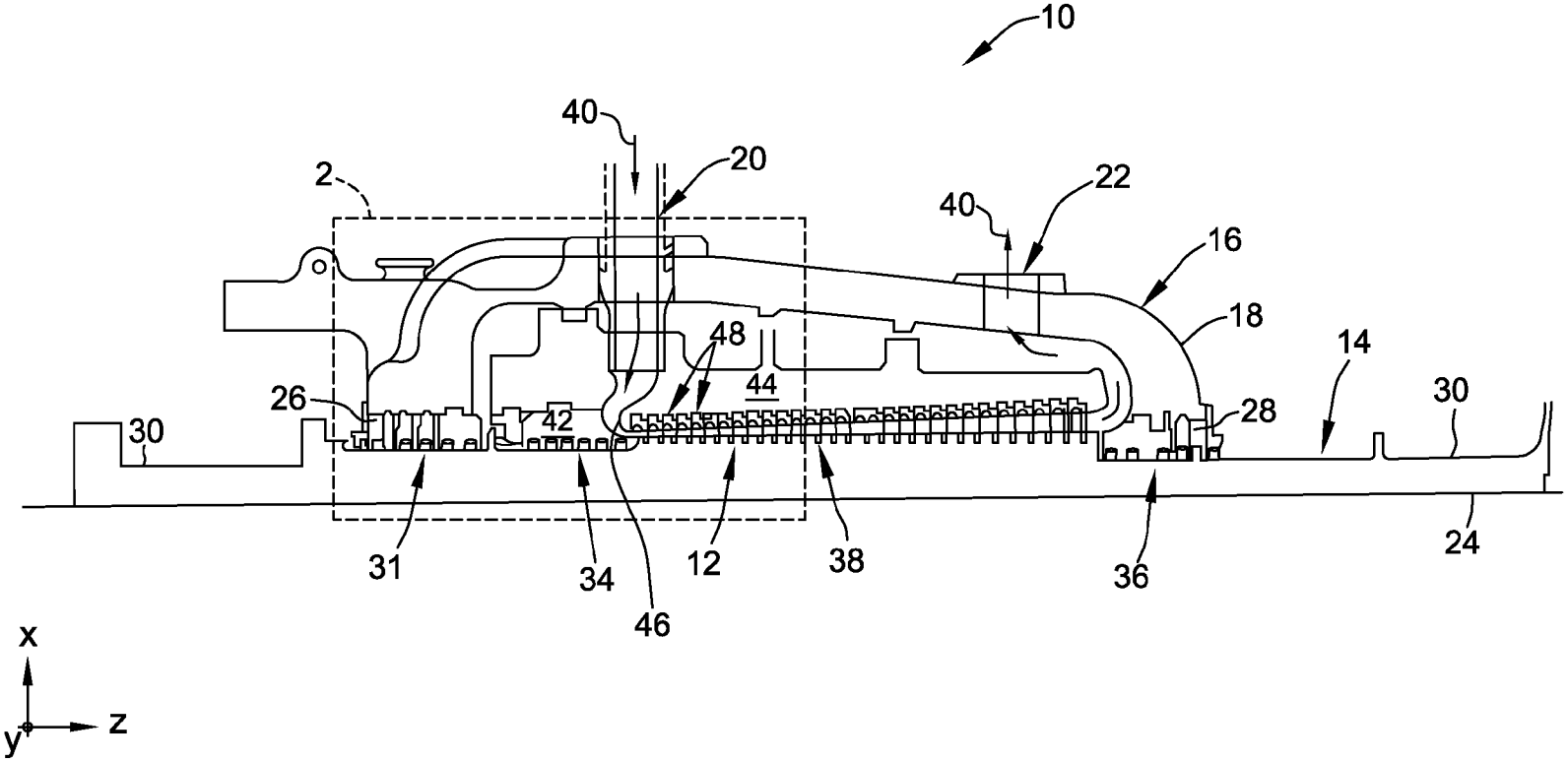
FIG. 1 is a schematic view of an exemplary steam turbine engine.

FIG. 1 is a schematic view of an exemplary steam turbine engine 10. While FIG. 1 describes an exemplary steam turbine engine, it should be noted that the bucket keying systems and methods described herein are not limited to any one particular type of turbine engine. One of ordinary skill in the art should appreciate that the current bucket keying systems and methods described herein may be used with any rotary machine, including a gas turbine engine, in any suitable configuration that enables such an apparatus, system, and method to operate as further described herein.

In the exemplary embodiment, steam turbine engine 10 is a single-flow steam turbine engine. Alternatively, steam turbine engine 10 may be any type of steam turbine, such as, without limitation, a low-pressure turbine engine, an opposed-flow high-pressure and intermediate-pressure steam turbine combination, a double-flow steam turbine engine, and/or other steam turbine types. Moreover, as discussed above, the present invention is not limited to only being used in steam turbine engines and can be used in other turbine systems, such as gas turbine engines.

In the exemplary embodiment shown in FIG. 1, steam turbine engine 10 includes a plurality of turbine stages 12 that are coupled to a rotatable shaft 14. A casing 16 is divided axially into an upper half section 18 and a lower half section (not shown). Upper half section 18 includes a high pressure (HP) steam inlet 20 and a low pressure (LP) steam outlet 22. Shaft 14 extends through casing 16 along a centerline axis 24, and is supported by bearings located generally adjacent end packing portions 26 and 28, that are each rotatably coupled to opposite end portions 30 of shaft 14. A plurality of sealing members 31, 34, and 36 are coupled between rotatable shaft end portions 30 and casing 16 to facilitate sealing casing 16 about shaft 14.

In the exemplary embodiment, steam turbine engine 10 also includes a stator component 42 coupled to an inner shell 44 of casing 16. Sealing members 34 are coupled to stator component 42. Casing 16, inner shell 44, and stator component 42 each extend circumferentially about shaft 14 and sealing members 34. In the exemplary embodiment, sealing members 34 form a tortuous sealing path between stator component 42 and shaft 14. Shaft 14 includes a plurality of turbine stages 12 through which high-pressure high-temperature steam 40 is passed via steam channel 46. Turbine stages 12 include a plurality of inlet nozzles 48. Steam turbine engine 10 may include any number of inlet nozzles 48 that enables steam turbine engine 10 to operate as described herein. For example, steam turbine engine 10 may include more or less inlet nozzles 48 than are illustrated in FIG. 1. Turbine stages 12 also include a plurality of turbine blades or buckets 38. Steam turbine engine 10 may include any number of buckets 38 that enables steam turbine engine 10 to operate as described herein. Steam channel 46 typically passes through casing 16. Steam 40 enters steam channel 46 through HP steam inlet 20 and flows along shaft 14 through turbine stages 12.

During operation, high pressure and high temperature steam 40 is channeled to turbine stages 12 from a steam source, such as a boiler (not shown), wherein thermal energy is converted to mechanical rotational energy by turbine stages 12. More specifically, steam 40 is channeled through casing 16 from HP steam inlet 20 where it impacts the plurality of turbine blades or buckets 38, coupled to shaft 14 to induce rotation of shaft 14 about centerline axis 24. Steam 40 exits casing 16 at LP steam outlet 22. Steam 40 may then be channeled to the boiler (not shown) where it may be reheated or channeled to other components of the system, e.g., a condenser (not shown).

Figure 2:
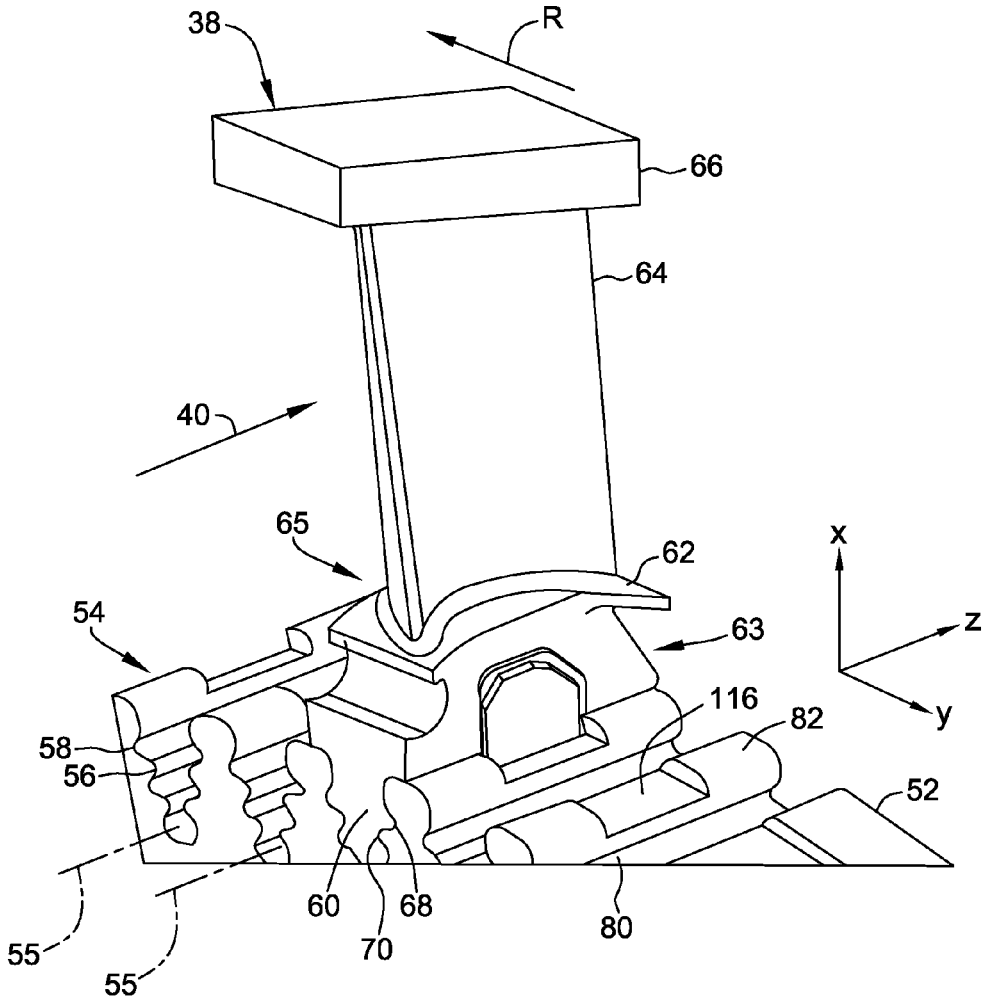
FIG. 2 is a perspective view of a portion of an exemplary rotor wheel assembly that may be used with the steam turbine engine shown in FIG. 1.

FIG. 2 is a perspective view of a portion of an exemplary rotor wheel assembly 50 that may be used with steam turbine engine 10 (shown in FIG. 1). In the exemplary embodiment, rotor wheel assembly 50 includes a rotor wheel 52 including a plurality of axial entry dovetail slots 54 defined therein that are substantially equi-spaced about an outer periphery of rotor wheel 52. Each dovetail slot 54 is oriented substantially parallel to centerline axis 24 (shown in FIG. 1) as generally indicated by centerline 55. Centerline axis 24 corresponds to the axis of rotation of rotor wheel 52. Alternatively, dovetail slots 54 may be oriented in rotor wheel 52 at any angle relative to centerline axis 24 that enables steam turbine engine 10 to function as described herein. In the exemplary embodiment, each dovetail slot 54 is generally V-shaped and includes a series of axially-extending circumferential projections 56 and grooves 58. In the exemplary embodiment, each dovetail slot 54 is substantially symmetrical and extends radially-inward from the outer periphery of rotor wheel 52.

As shown in FIG. 2, rotor wheel 52 rotates in the direction indicated by arrow R as steam 40 flows though rotor wheel assembly 50. Centerline axis 24 is substantially parallel to the Z-axis of the coordinate system (shown in FIG. 1), wherein the primary flow direction of steam 40 is generally along the Z-axis.

In the exemplary embodiment, each bucket 38 includes a root portion or dovetail 60, a platform 62, an airfoil 64, and an integral cover 66. With reference to the coordinate system, the most forward circumferential side of each bucket 38 with respect to the direction of rotation of rotor wheel assembly 50 is referred to as a leading side 65. The opposite circumferential side of each bucket 38, or the most rearward side with respect to the positive direction of the Y-axis, is referred to as a trailing side 63.

In the exemplary embodiment, dovetail 60 is formed with a shape that is substantially complementary to a respective dovetail slot 54 and each includes a series of axially-extending circumferential projections 68 and grooves 70 that interlock with a respective dovetail slot 54. In the exemplary embodiment, dovetail slot 54 and dovetail 60 are each substantially parallel to centerline axis 24 of steam turbine engine 10 (shown in FIG. 1), such that buckets 38 can be coupled to rotor wheel 52 as a dovetail 60 of a respective bucket 38 is inserted axially into a respective dovetail slot 54. When assembled, buckets 38 form an array of buckets that extend circumferentially about the outer periphery of rotor wheel 52.

Figure 3:
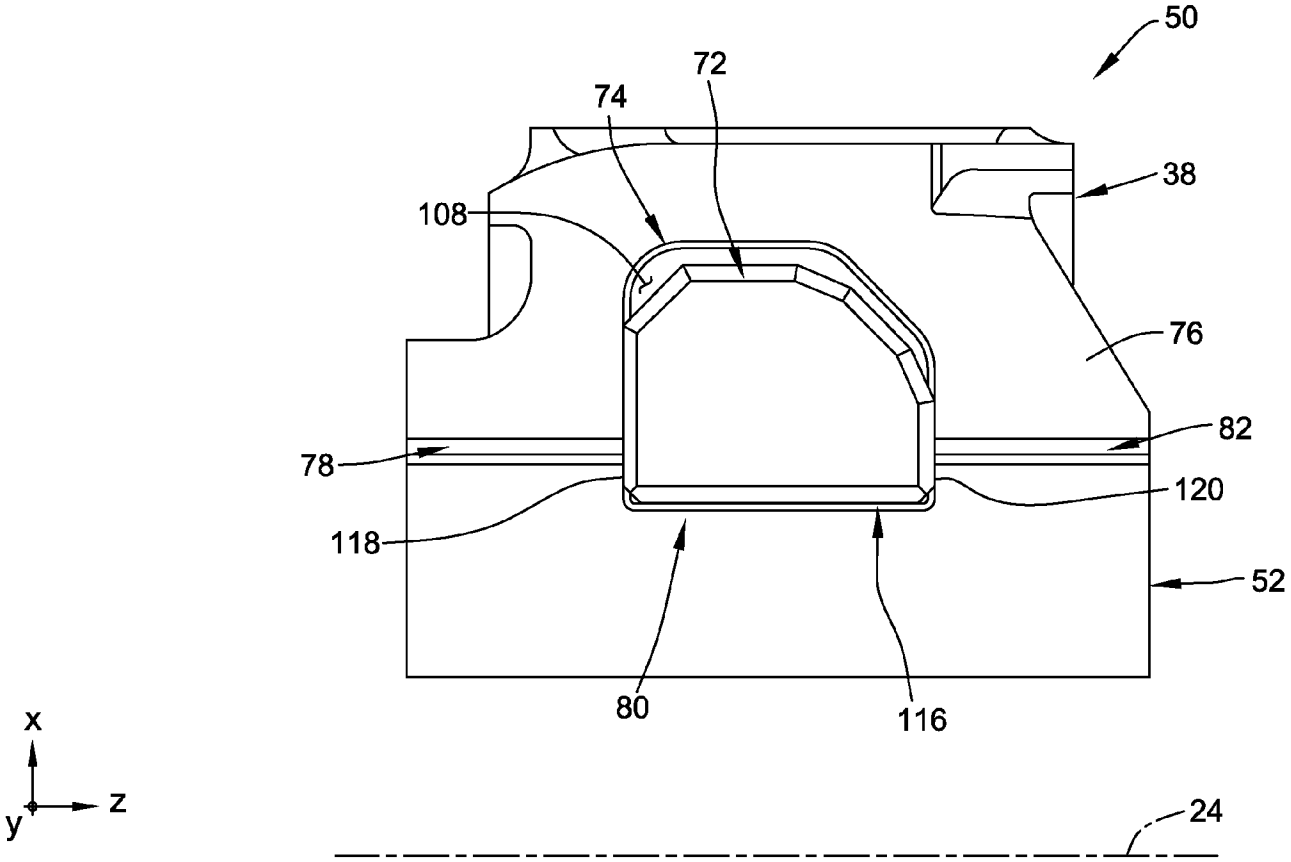
FIG. 3 is a partial side view of the rotor wheel assembly of the steam turbine engine shown in FIG. 1, and looking substantially perpendicular to the X-Z plane.

FIG. 3 is a partial side view of rotor wheel assembly 50 of steam turbine engine 10 (shown in FIG. 1) as viewed substantially perpendicular to the X-Z plane. More specifically, FIG. 3 is an enlarged partial side view looking at trailing side 63 of bucket 38 and illustrating an exemplary wedge key 72 for use in locking bucket 38 to rotor wheel 52. In the exemplary embodiment, bucket 38 includes a keyway 74 defined in a trailing side surface 76 of platform 62. Keyway 74 extends below trailing side surface 76 to a keyway surface 108. Trailing side surface 76 faces circumferentially with respect to rotor wheel 52 and is substantially parallel to a radial plane including centerline axis 24 and extending radially-outward from rotor wheel 52. In the exemplary embodiment, keyway 74 is generally centered within platform 62 in an axial direction corresponding with the Z-axis, and extends through a bottom surface 78 of platform 62. Rotor wheel 52 includes a corresponding notch 80 defined in a peripheral surface 82 of rotor wheel 52 and extending between respective dovetail slots 54. Notch 80 is defined by a bottom surface 116, a front edge 118, and a rear edge 120. Notch 80 is open to peripheral surface 82. Moreover, notch 80 is substantially rectangular and is generally aligned with keyway 74, i.e., both keyway 74 and notch 80 have a substantially similar length in the Z-axis direction.

FIG. 4 is a partial side view of bucket 38 of rotor wheel assembly 50 (shown in FIG. 2) looking substantially perpendicular to the X-Z plane. In the exemplary embodiment, keyway 74 includes a front edge 84 and rear edge 86 that are each oriented substantially perpendicular to centerline axis 24, a top edge 88 that is substantially parallel to centerline axis 24, and an angled edge 90 that extends between top edge 88 and rear edge 86. Alternatively, keyway 74 may not include angled edge 90, such that top edge 88 extends between front edge 84 and rear edge 86. In the exemplary embodiment, angled edge 90 is oriented at an angle $\alpha$ with respect to rear edge 86. Angle $\alpha$ is between about 30° to about 90°, wherein at 90°, angled edge 90 is eliminated as described above. Alternatively, angle $\alpha$ may be formed at any angle that enables keyway 74 to operate as described herein. Angled edge 90 functions to facilitate providing a means to assure that wedge key 72 is assembled in the proper orientation and to provide clearance at the trailing side 63 of platform 62. Each intersection between keyway edges 84, 86, 88, and 90 is defined by an arcuate corner 92 that facilitates reducing stress points in platform 62 of bucket 38. Alternatively, keyway 74 may be any shape that enables keyway 74 to operate as described herein.

Figure 5:
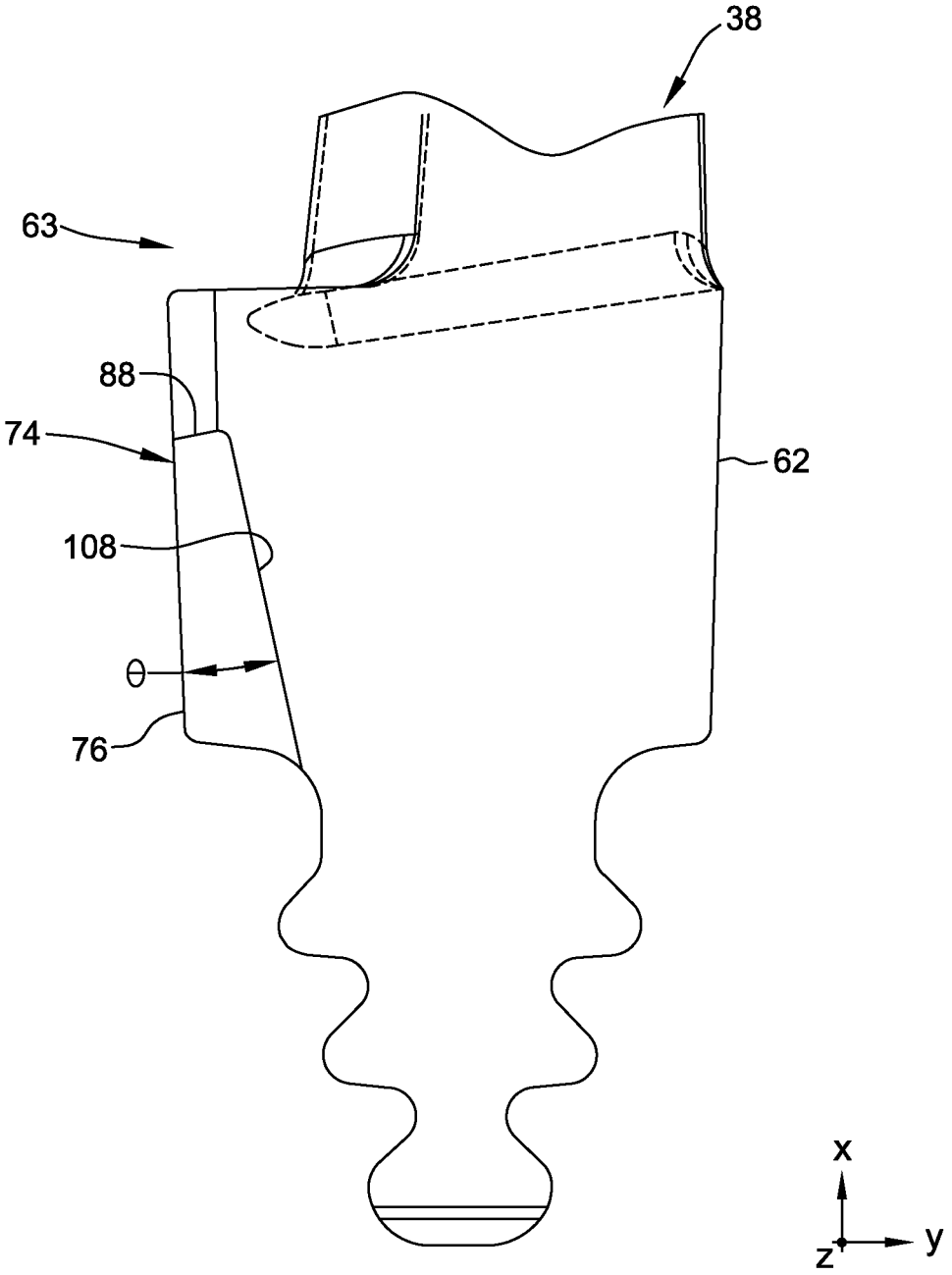
FIG. 5 is a section view of the bucket taken along section line 5-5 shown in FIG. 4.

FIG. 5 is a section view of bucket 38 taken along section line 5-5. In the exemplary embodiment, keyway 74 extends through trailing side surface 76 of platform 62 to keyway surface 108. Keyway surface 108 extends axially along the Z-axis and is inclined with respect to trailing side surface 76 at an angle $\theta$ with trailing side surface 76. Keyway surface 108, angled at angle $\theta$, forms a locking taper with wedge key 72. In the exemplary embodiment, angle $\theta$ is between about 1° to about 15°. Alternatively, angle $\theta$ may be formed at any angle that enables keyway 74 to operate as described herein.

Figure 6:
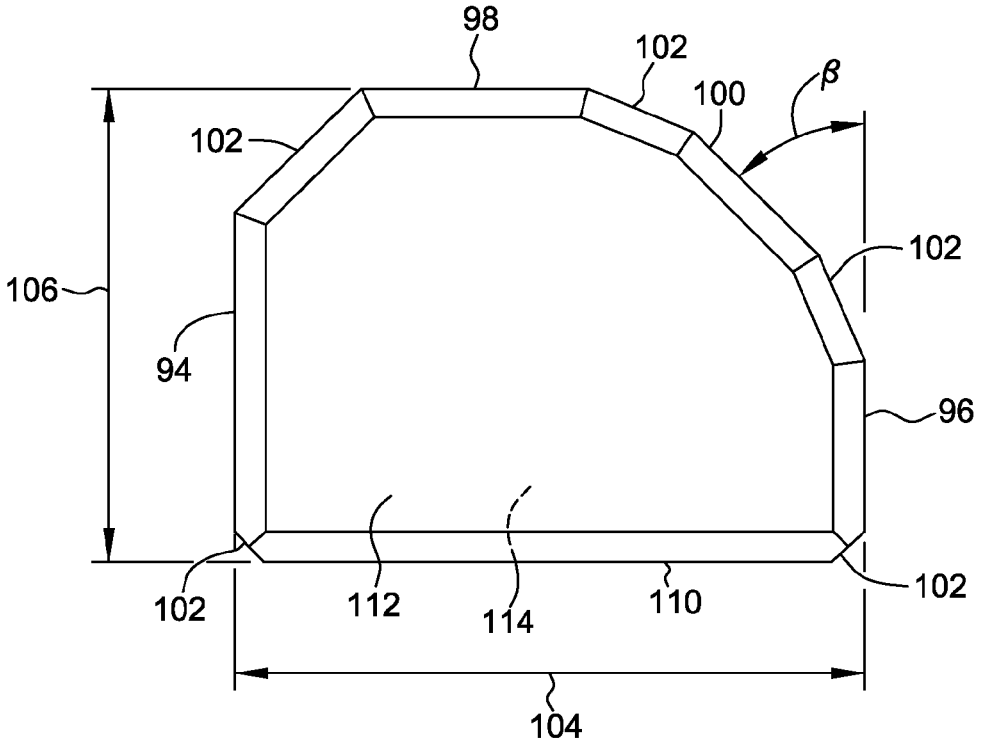
FIG. 6 is a side view of an exemplary wedge key that may be used with the rotor wheel assembly shown in FIG. 2.

FIG. 6 is a side view of wedge key 72 for use with rotor wheel assembly 50 (shown in FIG. 2). In the exemplary embodiment, wedge key 72 is shaped generally complimentary to keyway 74, i.e., wedge key 72 includes a front edge 94 and rear edge 96 that are substantially parallel to each other, a top edge 98 and a bottom edge 110 that are oriented substantially perpendicular to front edge 94 and rear edge 96, and an angled edge 100 extending between top edge 88 and rear edge 86. Alternatively, wedge key 72 may not include angled edge 100, such that top edge 98 extends between front edge 94 and rear edge 96. In the exemplary embodiment, angled edge 100 is formed at an angle $\beta$ with respect to rear edge 86. Angle $\beta$ is approximately the same as angle $\alpha$ of keyway 74 and is between about 30° to about 90°, wherein at 90°, angled edge 100 is eliminated as described above. Alternatively, angle $\beta$ may be formed at any angle that enables wedge key 72 to operate as described herein. In the exemplary embodiment, each intersection between edges 94, 96, 98, 100, and 110 includes a chamfer 102 to facilitate slidably coupling wedge key 72 with keyway 74. Alternatively, keyway 74 may be any shape that enables keyway 74 to operate as described herein. In the exemplary embodiment, wedge key 72 has a width 104 and a height 106 that enable wedge key 72 to substantially align with keyway 74 and notch 80, while enabling wedge key 72 to move vertically within keyway 74 and notch 80.

Figure 7:
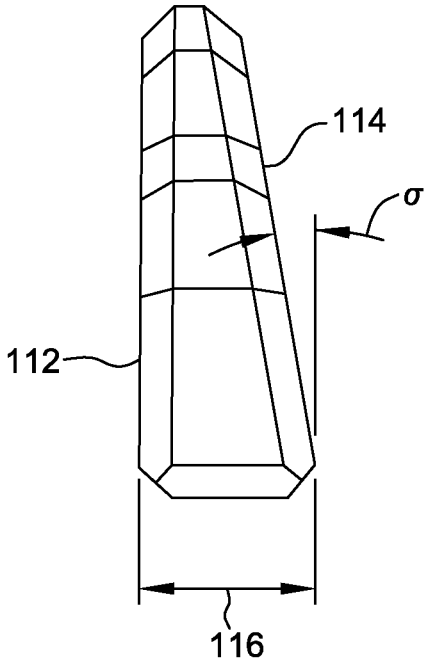
FIG. 7 is an end view of the wedge key shown in FIG. 6.

FIG. 7 is an end view of wedge key 72. In the exemplary embodiment, wedge key 72 includes a front face 112 and a rear face 114. Rear face 114 is formed at an angle $\sigma$ with respect to front face 112. In the exemplary embodiment, rear face 114, angled at angle $\sigma$, forms a locking taper with keyway 74. As such, angle $\sigma$ is approximately the same as angle $\therefore$ In the exemplary embodiment, angle $\sigma$ is between about 1° to about 15°. Alternatively, angle $\sigma$ may be formed at any angle that enables wedge key 72 to operate as described herein.

Figure 8:
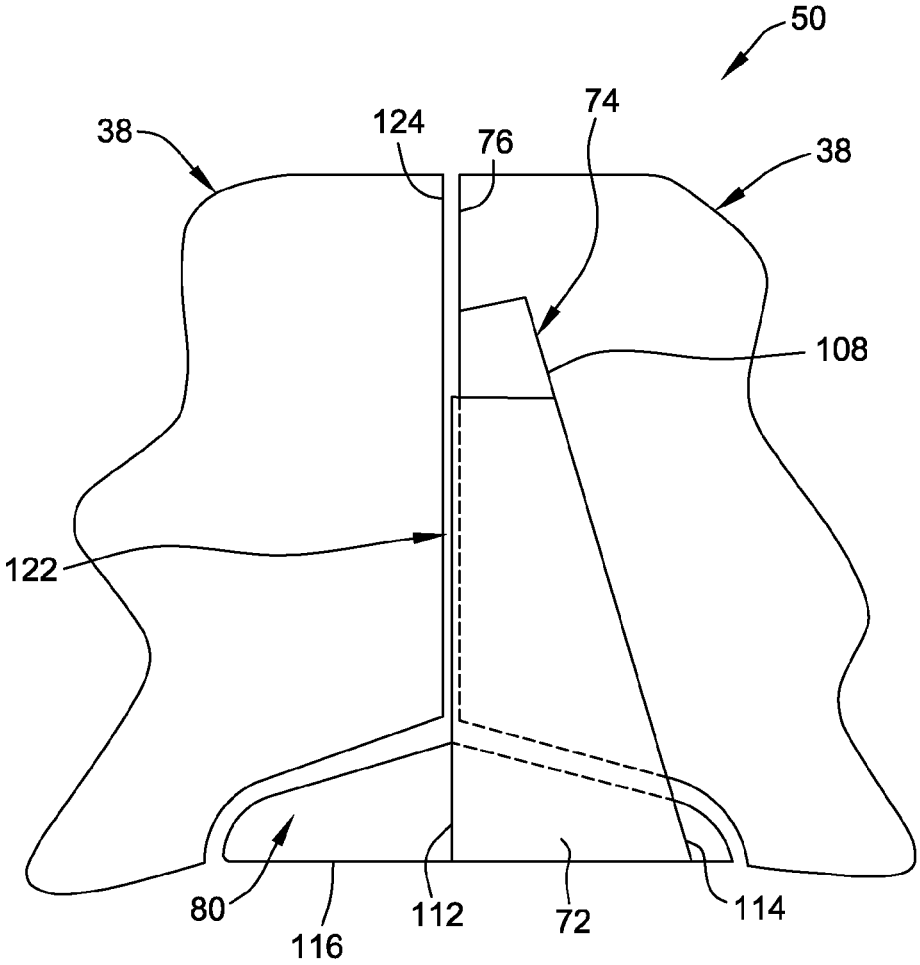
FIG. 8 is a partial sectional view of the rotor wheel assembly shown in FIG. 2, illustrating the wedge key inserted between a pair of buckets during assembly of the rotor wheel assembly.

FIG. 8 is a partial section view of rotor wheel assembly 50 illustrating wedge key 72 inserted between a pair of buckets 38 during assembly of rotor wheel assembly 50. Referencing FIGS. 2, 3, and 8, in operation, bucket 38 is inserted into dovetail slot 54 of rotor wheel 52 such that keyway 74 is aligned with notch 80. In particular, front edge 118 of notch 80 and front edge 84 of keyway 74 are aligned such that they are substantially collinear when viewed in the X-Z plane (shown in FIG. 3). In addition, rear edge 120 of notch 80 and rear edge 86 of keyway 74 are aligned such that they are substantially collinear when viewed in the X-Z plane. Wedge key 72 is inserted at least partially into keyway 74 of bucket 38. Wedge key 72 is also inserted at least partially into notch 80 of rotor wheel 52. After insertion into keyway 74 and notch 80, wedge key 72 is captured in both the axial (Z-axis) and the radial (X-axis) directions thereby providing positive axial securement of bucket 38 to rotor wheel 52. As each subsequent bucket 38 is inserted into a respective dovetail slot 54, wedge key 72 is captured in the circumferential (Y-axis) direction. In the exemplary embodiment, rear face 114 of wedge key 72 is mated against corresponding keyway surface 108 and rests on bottom surface 116 of notch 80. This position may be referred to as the radially-inward position of wedge key 72. At the radially-inward position of wedge key 72, a gap 122 is defined between front face 112 of wedge key 72 and a leading side surface 124 of an adjacent bucket 38. Gap 122 enables assembly of the adjacent bucket 38.

Figure 9:
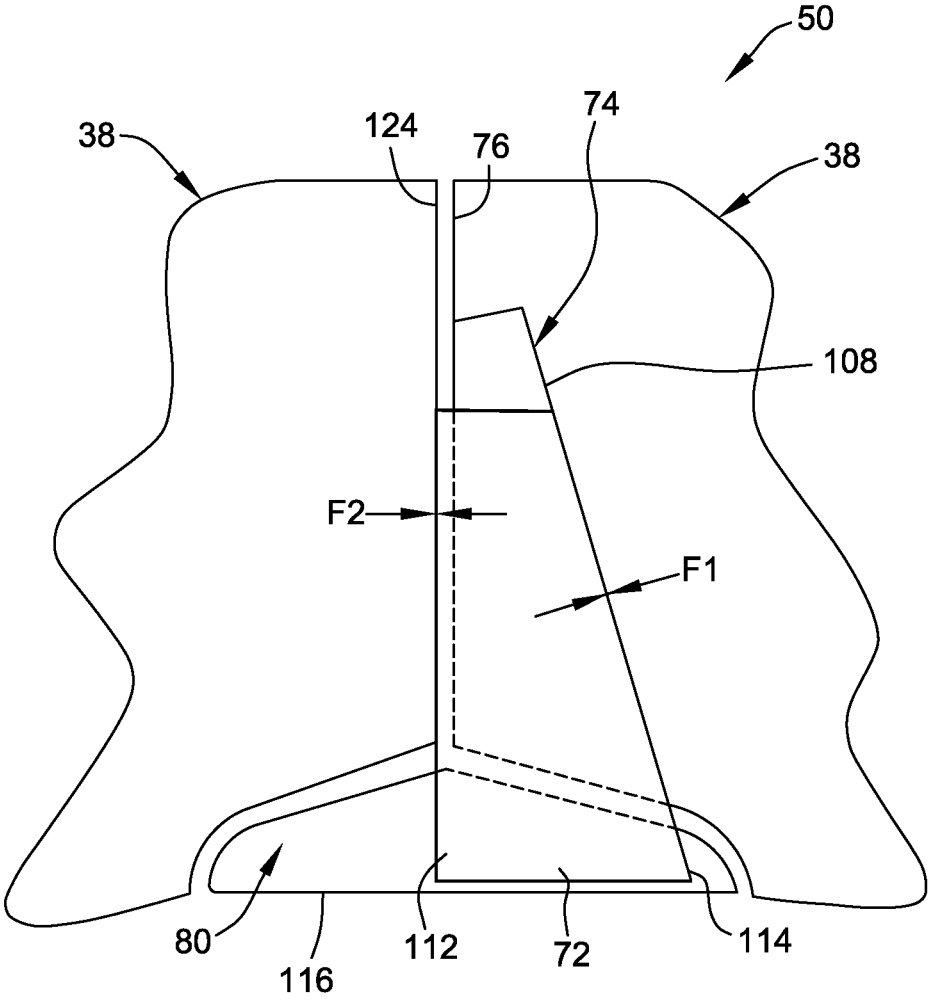
FIG. 9 is a partial sectional view of the rotor wheel assembly shown in FIG. 2, illustrating the wedge key between a pair of buckets after rotating the rotor wheel assembly up to operating speed.

FIG. 9 is a partial sectional view of rotor wheel assembly 50 illustrating wedge key 72 positioned between a pair of buckets 38 after rotating rotor wheel assembly 50 up to operating speed. In the exemplary embodiment, wedge key 72 is moved to a radially-outward position due to centrifugal force generated during the rotating of rotor wheel assembly 50 at operating speed. In the radially-outward position of wedge key 72, front face 112 of wedge key 72 is mated against leading side surface 124 of adjacent bucket 38, thereby eliminating gap 122. The radially-outward position of wedge key 72 generates a tight coupling between wedge key 72 and trailing side surface 76 and leading side surface 124 of adjacent buckets 38. Angle θ of keyway surface 108 and the complimentary angle σ of wedge key 72 facilitate forming a locking taper, thereby securely coupling wedge key 72 in the radially-outward position between adjacent buckets 38 when rotor wheel assembly 50 is no longer rotating. The locking taper formed between keyway surface 108 and wedge key 72 generates frictional contact forces F1 between rear face 114 of wedge key 72 and corresponding keyway surface 108. Moreover, frictional contact forces F2 are generated between front face 112 of wedge key 72 and leading side surface 124 of adjacent bucket 38. Frictional contact forces F1 and F2 couple wedge key 72 in the radially-outward position between adjacent buckets 38. Coupling wedge key 72 in the radially-outward position enables buckets 38 to be positioned in a radially-outward direction, even when rotor wheel assembly 50 is at rest, such that bucket dovetails 60 and rotor wheel dovetail slots 54 remain tightly coupled.

In operation, coupling platforms 62 to adjacent buckets 38 facilitates increasing the natural frequencies of buckets 38. Increasing the natural frequencies of buckets 38 facilitates reducing dynamic stresses generated in dovetail 60 of bucket 38, and enables assembled vibration tests to be performed on rotor wheel assembly 50 while it is at rest. Enabling assembled vibration tests while steam turbine 10 is at rest facilitates reducing expenses and reducing manufacturing cycle time of steam turbine engine 10 by reducing the need to perform a wheel box or spin-cell vibration test. The use of wedge key 72 with integrally covered buckets facilitates enabling a condition where the basic boundary conditions existing at rotor wheel assembly 50 operating speed also exists at a resting condition of rotor wheel assembly 50, thereby enabling standing assembled vibration testing for tuning and validation purposes of steam turbine engine 10.

The systems and methods described herein facilitate improving turbine engine performance by providing an axial entry bucket keying system that substantially reduces operating stresses induced to a turbine and enables standing assembled vibration testing for tuning and validation purposes. Specifically, a wedge key, having a locking taper, in combination with a bucket, having a tapered keyway, is described. Therefore, in contrast to known turbines that use axial entry buckets, the apparatus, systems, and methods described herein facilitate reducing the time and difficulty in assembling axial entry buckets, facilitate reducing operating stresses and cost associated with dovetail closure inserts, and enable coupling at the bucket platforms to raise bucket natural frequencies, to reduce dynamic stresses in the dovetail, and to allow for acquisition of accurate standing assembled vibration test data for tuning and frequency validation purposes.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the invention has been described in terms of various specific embodiments, those skilled in the art will recognize that the invention can be practiced with modification within the spirit and scope of the claims.

What is claimed is:

1. A rotor wheel assembly comprising:

a rotor wheel comprising a plurality of dovetail slots spaced circumferentially about a peripheral surface of said rotor wheel, and a plurality of notches formed in said peripheral surface;

a first bucket coupled to said rotor wheel, said first bucket comprising an integral cover, an airfoil, a dovetail, and a platform comprising a first circumferential surface and an opposite second circumferential surface, said first circumferential surface comprising a keyway defined therein, said keyway defining a cavity in said first circumferential surface, said keyway comprising a forward surface, a rearward surface, and an opposing circumferential tapered surface oriented at a first angle relative to said platform first circumferential surface;

a second bucket coupled to said rotor wheel adjacent said first bucket, said second bucket comprising a platform comprising a third circumferential surface facing said first circumferential surface; and a wedge key comprising a first face oriented substantially parallel to said platform first circumferential surface and an opposite second face oriented at said first angle relative to said first face, said second face is substantially parallel to said circumferential tapered surface, said wedge key disposed in said keyway and positionable between a first position in which said wedge key does not contact said second bucket, and a second position in which said wedge key is in face-to-face contact with said keyway circumferential tapered surface and said second bucket third circumferential surface, wherein said wedge key couples said first bucket to said second bucket, and wherein a frictional contact force is generated between said first bucket and said wedge key, and said second bucket and said wedge key.

2. A rotor wheel assembly in accordance with claim 1, wherein each of said plurality of notches has an axial length that is approximately the same as an axial length of said keyway.

3. A rotor wheel assembly in accordance with claim 1, wherein said rotor wheel has an axis of rotation, said plurality of dovetail slots comprise axial entry dovetail slots, such that each said dovetail slot extends substantially parallel to the axis of rotation.

4. A rotor wheel assembly in accordance with claim 1, wherein said wedge key has an axial width sized to enable said wedge key to slidably engage said keyway.

5. A rotor wheel assembly in accordance with claim 4, wherein said wedge key is configured to simultaneously slidably engage said keyway and one of said plurality of notches.

6. A rotor wheel assembly in accordance with claim 1, wherein a value of said first angle is between about 1° to about 15°.

7. A turbine engine comprising:

a rotatable shaft having an axis of rotation;

a casing extending circumferentially about said rotatable shaft, said casing defining at least one passage configured to channel a working fluid along a length of said rotatable shaft;

a rotor wheel assembly coupled to a portion of said rotatable shaft for rotation therewith, said rotor wheel assembly configured to expand the working fluid, said rotor wheel assembly comprising:

a rotor wheel comprising a plurality of dovetail slots spaced circumferentially about a peripheral surface of said rotor wheel, and a plurality of notches formed in said peripheral surface;

a plurality of buckets arranged in a circumferential array about said axis of rotation, each respective bucket of said plurality of buckets comprising a dovetail configured to couple to a respective one of said plurality of dovetail slots, an airfoil, an integral cover formed integrally with said respective bucket, and a platform comprising a first circumferential surface and an opposite second circumferential surface, said first circumferential surface comprising a keyway defined therein, said keyway defining a cavity in said first circumferential surface, said keyway comprising a forward surface, a rearward surface, and an opposing tapered circumferential surface oriented at a first angle relative to said platform first circumferential surface; and at least one wedge key comprising a first face oriented substantially parallel to said platform first circumferential surface and an opposite second face oriented at said first angle relative to said first face, said second face is substantially parallel to said tapered circumferential surface, said at least one wedge key disposed between adjacent buckets of said plurality of buckets and in said keyway, said at least one wedge key configured to generate a frictional contact force between said adjacent buckets to couple said adjacent buckets to each other.

8. A turbine engine in accordance with claim 7, wherein said plurality of dovetail slots are oriented at a second angle relative to said axis of rotation.

9. A turbine engine in accordance with claim 8, wherein said plurality of dovetail slots comprise axial entry dovetail slots, such that said second angle is approximately 0°.

10. A turbine engine in accordance with claim 7, wherein said wedge key second face is configured to engage said tapered circumferential surface of a respective one of said plurality of buckets, and a bottom surface of said wedge key is configured to engage a bottom surface of a respective one of said plurality of notches simultaneously, such that an adjacent bucket of said plurality of buckets can couple to an adjacent respective one of said plurality of dovetail slots.

11. A turbine engine in accordance with claim 7, wherein said wedge key second face is configured to engage said tapered circumferential surface of a first bucket of said adjacent buckets, and said wedge key first face is configured to mate against said second circumferential surface of a second bucket of said adjacent buckets.

12. A turbine engine in accordance with claim 11, wherein said first angle is configured to enable a locking taper between said wedge key and a respective one of said plurality of buckets, such that said platform of a respective one of said plurality of buckets is coupled to said platform of an adjacent respective one of said plurality of buckets to facilitate increasing a natural frequency of said respective buckets.

13. A turbine engine in accordance with claim 12, wherein a value of said first angle is between about 1° to about 15°.

14. A turbine engine in accordance with claim 7, wherein said at least one wedge key is configured to simultaneously slidably engage one of said keyways and one of said plurality of notches.

15. A method of assembling a rotor wheel assembly having a plurality of buckets and a rotor wheel having a plurality of dovetail slots spaced circumferentially about a periphery of the rotor wheel, wherein each bucket of the plurality of buckets includes a dovetail, a platform, an airfoil, and an integral cover, said method comprising:

coupling a first bucket to the rotor wheel comprising inserting the dovetail of the first bucket into a first dovetail slot;

securing the first bucket to the rotor wheel using a wedge key;

coupling a second bucket to the rotor wheel comprising inserting the dovetail of the second bucket into a second dovetail slot adjacent the first dovetail slot proximate the wedge key;

rotating the rotor wheel assembly up to an operating speed; and coupling the first bucket to the second bucket using the wedge key, wherein a frictional contact force is generated between the first bucket and the wedge key, and the second bucket and the wedge key.

16. The method in accordance with claim 15, wherein securing the first bucket to the rotor wheel using a wedge key comprises inserting the wedge key into a keyway formed in the platform of the first bucket.

17. The method in accordance with claim 16, wherein the platform of the first bucket includes a first surface, the first surface having the keyway formed therein, wherein the keyway includes an opposing tapered surface oriented at a first angle relative to the first surface.

18. The method in accordance with claim 17, wherein coupling the first bucket to the second bucket comprises using a wedge key having first face substantially parallel to the platform first surface and a second face substantially parallel to the opposing tapered surface.

19. The method in accordance with claim 15, wherein coupling the first bucket to the second bucket comprises coupling the first bucket platform to the second bucket platform to facilitate increasing a natural frequency of the first bucket and the second bucket.

20. The method in accordance with claim 15, further comprising reducing the rotor wheel assembly from the operating speed to a resting condition and acquiring standing vibration test data of the rotor wheel assembly for use in tuning and frequency validation.

* * * * *